US011024255B2

(12) United States Patent
Marcu et al.

(10) Patent No.: US 11,024,255 B2
(45) Date of Patent: Jun. 1, 2021

(54) METHOD AND APPARATUS FOR COLOR CALIBRATION FOR REDUCED MOTION-INDUCED COLOR BREAKUP

(71) Applicant: Apple Inc., Cupertino, CA (US)

(72) Inventors: Gabriel Marcu, San Jose, CA (US); Rong Liu, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/406,076

(22) Filed: May 8, 2019

(65) Prior Publication Data

US 2020/0357360 A1 Nov. 12, 2020

(51) Int. Cl.
*G09G 5/02* (2006.01)

(52) U.S. Cl.
CPC ..... *G09G 5/02* (2013.01); *G09G 2320/0242* (2013.01); *G09G 2320/0693* (2013.01)

(58) Field of Classification Search
CPC ..... G09G 5/02; G09G 2320/024; G09G 2320/0693; G09G 2320/0666; G09G 2320/0242; G09G 2360/145; G09G 2360/16; G09G 3/2003; G09G 5/026; G09G 3/3406
See application file for complete search history.

(56) References Cited

U.S. PATENT DOCUMENTS

| | | | | |
|---|---|---|---|---|
| 7,227,596 | B2 | 6/2007 | Weitbruch | |
| 7,479,934 | B2 | 1/2009 | Thebault | |
| 2007/0013614 | A1 | 1/2007 | Oh | |
| 2007/0052735 | A1* | 3/2007 | Chou | G09G 3/2003 345/690 |
| 2008/0049048 | A1* | 2/2008 | Credelle | G09G 3/2074 345/690 |
| 2010/0052575 | A1* | 3/2010 | Feng | G09G 3/3426 315/308 |
| 2018/0308452 | A1* | 10/2018 | Zhang | G09G 5/10 |

* cited by examiner

*Primary Examiner* — Xilin Guo
(74) *Attorney, Agent, or Firm* — Blank Rome LLP

(57) ABSTRACT

A display panel is calibrated to a target white point. A maximum luminance value of the display panel is attenuated from a first luminance value associated with the target white point to a second luminance value based on an attenuation factor. The second luminance value is equal to or lower than the first luminance value. The display panel is re-calibrated based on a chromaticity of the target white point and the second luminance value to generate calibration data. The calibration data is flashed into memory associated with the display panel. During operation, the white point of the panel may be shifted from the target to a chromatically imbalanced (e.g., reddish) white point that may cause motion-induced color trail or color breakup artifacts. The attenuated second luminance value ensures the motion-induced color trail or color breakup artifacts are adequately masked when the panel is driven with the chromatically imbalanced white point.

20 Claims, 6 Drawing Sheets

METHOD AND APPARATUS FOR COLOR CALIBRATION FOR REDUCED MOTION-INDUCED COLOR BREAKUP

TECHNICAL FIELD

This disclosure relates generally to a method and system for color calibration of a display. More particularly, but not by way of limitation, this disclosure relates to attenuating a maximum luminance of a display panel when calibrating to a target white point to reduce motion-induced color breakup or color trail artifacts.

BACKGROUND

Modern consumer electronic devices incorporate display devices (e.g., liquid crystal display (LCD), organic light emitting diode (OLED), plasma, digital light processing (DLP), and the like) to exchange information with users. Operational characteristics of the display devices may vary from device to device due to inherent properties of the display devices. For example, variations may exist in LCD components, such as backlight variations due to light emitting diode (LED) wavelength and phosphor concentration, color filter thickness, and the like. Thus, each display device may have slightly different color characteristics, white point, and the like.

SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one embodiment, a display color calibration method includes: calibrating a display panel to a target white point; attenuating a maximum luminance value of the display panel from a first luminance value associated with the target white point to a second luminance value based on an attenuation factor, wherein the second luminance value is equal to or lower than the first luminance value; re-calibrating the display panel based on a chromaticity of the target white point and the second luminance value to generate calibration data; and flashing the calibration data into memory associated with the display panel. The attenuation factor may be a function (e.g., a predetermined function selected based on empirical data) of the first luminance value so that the attenuation factor is higher when the first luminance value is larger.

In another embodiment, the method further includes measuring a color shift of a selected pattern displayed on the display panel by: displaying the selected pattern on the display panel; measuring an actual color response value of the selected pattern displayed on the display panel using a measurement instrument; and determining a panel-specific $\Delta E$ value based on a comparison of the measured actual color response of the selected pattern with a predetermined reference value associated with the selected pattern; wherein the attenuation factor is determined based on a comparison of the panel-specific $\Delta E$ value and a threshold $\Delta E$ value, and wherein the attenuation factor is determined based on a degree of the color shift of the selected pattern.

In yet another embodiment, the method may be embodied in computer executable program code and stored in a non-transitory storage device. In yet another embodiment, the method may be implemented on a system.

BRIEF DESCRIPTION OF THE DRAWINGS

While certain embodiments will be described in connection with the illustrative embodiments shown herein, the invention is not limited to those embodiments. On the contrary, all alternatives, modifications, and equivalents are included within the spirit and scope of the invention as defined by the claims. In the drawings, which are not to scale, the same reference numerals are used throughout the description and in the drawing figures for components and elements having the same structure, and primed reference numerals are used for components and elements having a similar function and construction to those components and elements having the same unprimed reference numerals.

DESCRIPTION

Figure 1:
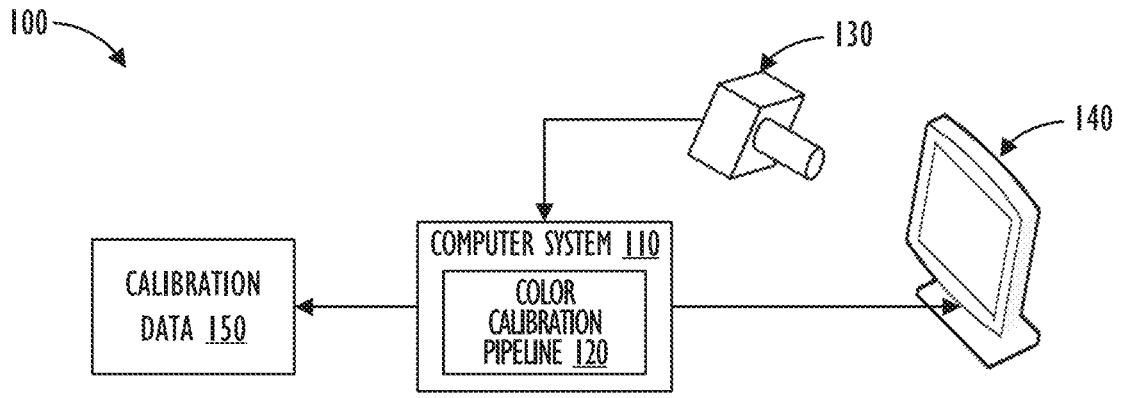
FIG. 1 shows, in block diagram form, a color calibration system for calibrating a display, in accordance with one or more embodiments.

In the following description, for purposes of explanation, numerous specific details are set forth in order to provide a thorough understanding of the inventive concept. As part of this description, some of this disclosure's drawings represent structures and devices in block diagram form in order to avoid obscuring the invention. In the interest of clarity, not all features of an actual implementation are described. Moreover, the language used in this disclosure has been principally selected for readability and instructional purposes, and may not have been selected to delineate or circumscribe the inventive subject matter, resort to the claims being necessary to determine such inventive subject matter. Reference in this disclosure to "one embodiment" or to "an embodiment" or "another embodiment" means that a particular feature, structure, or characteristic described in connection with the embodiment is included in at least one embodiment of the invention, and multiple references to "one embodiment" or "an embodiment" or "another embodiment" should not be understood as necessarily all referring to the same embodiment.

It will be appreciated that in the development of any actual implementation (as in any development project), numerous decisions must be made to achieve the developers' specific goals (e.g., compliance with system- and business-related constraints), and that these goals may vary from one implementation to another. It will also be appreciated that such development efforts might be complex and time-consuming, but would nevertheless be a routine undertaking for those of ordinary skill in the design and implementation of signal processing having the benefit of this disclosure.

The terms "a," "an," and "the" are not intended to refer to a singular entity unless explicitly so defined, but include the general class of which a specific example may be used for illustration. The use of the terms "a" or "an" may therefore mean any number that is at least one, including "one," "one or more," "at least one," and "one or more than one." The term "or" means any of the alternatives and any combination of the alternatives, including all of the alternatives, unless the alternatives are explicitly indicated as mutually exclusive. The phrase "at least one of" when combined with a list of items, means a single item from the list or any combination of items in the list. The phrase does not require all of the listed items unless explicitly so defined.

A white point of a display device may be defined as a color produced by the device when the device generates all colors at full power (e.g., without any correction or calibration applied). For example, when red, green, and blue channels for a display device are all active at full power (e.g., maximum voltage applied from display driver to each of the red, green, and blue sub-pixels of the display pixel), the chromaticity values, as measured in Cartesian coordinates x and y with respect to a chromaticity diagram, are the native white point of the display device. The white point may be defined by the pair of chromaticity values (x, y) as represented by x, y in the International Commission on Illumination (CIE) 1931 XYZ color space; or u,v in the CIELUV color space; and the like. White points may vary among display devices due to inherent properties such that when the red, green, and blue channels for a first display device are all active at full power, the resulting (x, y) chromaticity value corresponding to the native white point of the first display device is different from the (x, y) chromaticity value corresponding to the native white point of another display device when the red, green, and blue channels for the other display device are also all active at full power.

This native or original (uncorrected) white point of the display device may be corrected in a white point calibration process to be adjusted to a target white point which is consistent across multiple display devices. For example, the target white point may correspond to the D65 illuminant of the International Commission on Illumination (CIE). In the white point calibration, each device may be tuned (e.g., in a factory, or post-shipping during a calibration process) to the target white point by adjusting display control settings such as gain values for the red, green, and blue channels individually. Alternately, RGB adjustment values that produce the color (e.g., represented in a device-independent color space with target chromaticity coordinates $(x_0, y_0)$) corresponding to the target white point may be stored in a look up table (LUT). After calibration to the target white point, during operation of the device, the white point may be dynamically shifted from the target white point based on ambient light conditions or based on user operation such that the white point takes on different chromaticities or hues (e.g., yellowish-reddish hue, greenish hue, blueish hue, and the like).

In displays with a chromatically imbalanced white point (either intentionally or unintentionally imbalanced white point, e.g., having a yellowish-reddish hue, greenish hue, blueish hue, or the like), the phenomena of motion-induced color breakup and/or color trail artifacts may be experienced on the display to an undesirable degree, e.g., due to the consistently higher voltage levels applied to one or more color channels relative to the other color channels of the display causing lengthier 'turn off' times for the one or more color channels, resulting in an unwanted streak or 'color trail' artifact manifesting, e.g., around the periphery of a moving object on top of a black or white background.

A calibrated display panel may be driven in a mode that shifts the white point of the panel to a chromaticity away from the target white point (e.g., D65). For example, the white point of a calibrated display panel may be shifted based on ambient light conditions or based on user operation to a yellowish-reddish hue. Driving a display panel with such a shifted white point may cause an imbalance between the respective driving voltages for the R, G, and B sub-pixels and corresponding response times, which in turn causes a motion-induced color breakup or color trail artifact when the pixels transition from high to low gray levels (i.e., white to black) or vice-versa (i.e., black to white). For example, in the case of a yellowish-reddish white point, when a dark object moves across a yellowish-reddish white background on the display panel, the red sub-pixels turn on faster than the green and blue sub-pixels, causing a reddish trail following the dark object on the display panel. Conversely, when a yellowish-reddish white object moves across a dark background, the red sub-pixels turn off faster than the green and blue sub-pixels, causing a cyanish trail following the white object on the display panel.

Techniques disclosed herein look to address this motion-induced color breakup or color trail artifact by attenuating the maximum luminance of the display panel during a calibration stage (e.g., factory calibration). During the calibration stage, the display panel may first be calibrated to a target white point (e.g., D65) from a native response of the display panel where each of the R, G, and B sub-pixels are driven at full power. After calibrating to the target white point, a maximum luminance value of the display panel when the display panel is driven at the target white point may be obtained. Based on the obtained maximum luminance value, an attenuation factor by which the maximum luminance value is to be attenuated (e.g., lowered) may be determined. The attenuation factor may be a function of the obtained maximum luminance value so that the higher the maximum luminance value, the larger the attenuation factor is, and vice-versa. The attenuation function may be determined in advance based on empirical data. Alternately, the attenuation factor may be programmatically determined for each display panel during calibration by utilizing a measurement instrument to measure a color shift of the display panel while displaying a selected (e.g., still and/or moving) image pattern. A degree of the measured color shift may be compared to a predetermined just noticeable difference (JND) threshold (e.g., threshold $\Delta E$ value). Based on the comparison, the attenuation factor may be determined so that the degree of the color shift becomes lower than, e.g., the JND threshold. The attenuation factor may be determined as an optimum tradeoff between the amount of acceptable brightness loss of the display panel versus visibility of the color trailing artifact. Once the attenuation factor is determined, the display panel may be re-calibrated and calibration data (e.g., RGB adjustment values in a lookup table) generated based on the chromaticity of the target white point (e.g., D65) and the new attenuated maximum luminance value. The generated calibration data may be flashed into memory (e.g., timing controller (TCON)) of the display panel for driving the panel. In one embodiment, the amount of attenuation to be applied to the maximum luminance of the display panel may be further adjusted in real-time (dynamically) or at a post-factory calibration stage based on, e.g., ambient light conditions the viewer of the display panel is perceptually adapted to, settings or parameters input by the user, and the like.

Referring now to FIG. 1, display color calibration system 100 for performing color calibration of a display panel in accordance with one or more embodiments is illustrated. Color calibration system 100 may include display 140 (e.g., display device, display panel, and the like). Display 140 may be a standard gamut or wide gamut display and may be used to display text and graphic output as well as receiving user input via a user interface. The design and implementation of display 140 may differ depending on the type of the display device. Non-limiting examples of display device types include liquid crystal displays, plasma displays, quantum dot-based displays, and light emitting diode displays (e.g., organic light emitting diode displays), digital light processing, and the like. Display 140 may be a standalone display device like a computer monitor, television screen, and the like, or may be a display panel incorporated into an electronic device like a digital camera, a personal digital assistant (PDA), personal music player, mobile telephone, server, notebook, laptop, desktop, tablet computer, or other portable electronic device. In one embodiment, display 140 is an RGB display with color channels (sub-pixels) for red, green, and blue.

Color calibration system 100 may be implemented as part of an assembly line in a factory during manufacture of display 140 for performing color calibration of display 140 before shipping to a customer. Alternately, color calibration system 100 may also be implemented as an external calibration system that can be utilized on-demand by customers to self-calibrate display 140 by connecting color calibration system 100 to a system of display 140. Color calibration system 100 may further include measurement unit 130 (e.g., measurement instrument) that is connected to and controlled by computer system 110. Computer system 110 may include standard computer components like central processing unit (CPU), read-only memory (ROM), random access memory (RAM), storage device (e.g., hard disk), input/output devices (e.g., keyboard, mouse, monitor) and the like. Color calibration pipeline 120 for performing color calibration may be implemented on computer system 110. Color calibration performed by color calibration pipeline 120 may include different types of calibration pipelines for display 140. For example, color calibration pipeline 120 may perform white point calibration, maximum luminance attenuation for masking color trailing artifacts, and the like. Specific details of calibration performed by color calibration pipeline 120 are described below in connection with FIGS. 3-6.

During the calibration operation, computer system 110 may control operation of display 140, output test and calibration image or video color calibration signals (e.g., still and/or moving color patches or patterns) to display 140 and then query measurement unit 130 to determine what is actually displayed by display 140 in response to the output color calibration signals. Color calibration system 100 may perform calibration based on actually measured color response display values identified by computer system 110 as uncorrected output data from display 140 by measuring via measurement unit 130. In one embodiment, the color response values detected by measurement unit 130 may be in a device-independent color space like CIEXYZ color space, CIE xyY color space, the CIE LAB color space, and the like.

Based on the color response values measured by measurement unit 130, color calibration pipeline 120 implemented by computer system 110 may perform color calibration to generate calibration data (e.g., RGB adjustment values in one or more lookup tables (LUTs)) 150 for later use by display 140 during normal operation. The calibration data may be used for color correction so that a standard color or image signal (e.g., D65 white) that is supplied to display 140 will be rendered more faithfully by accounting for the unique characteristics of display 140.

Figure 2:
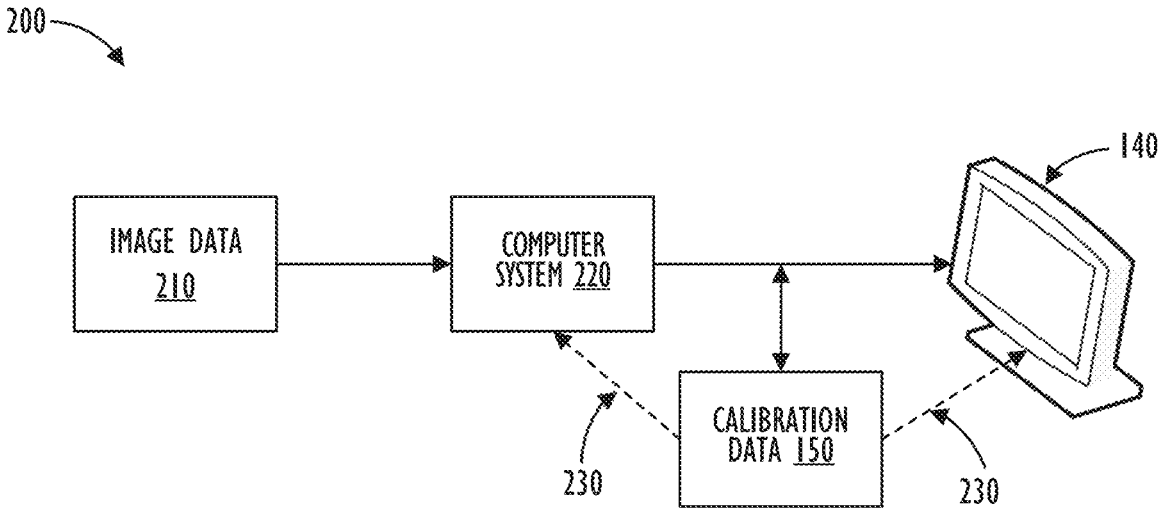
FIG. 2 is a block diagram depicting the operation of a calibrated display system, in accordance with one or more embodiments.

Referring now to FIG. 2, a block diagram depicting the operation of a calibrated display system 200 utilizing calibration data 150 in accordance with one or more embodiments, is illustrated. (Uncorrected) image data 210 may be provided to an image control unit, such as computer system 220 (including, e.g., CPU, ROM, RAM, hard disk, input-output devices, and the like), which in turn may provide a corrected image or video signal to display 140, as will be readily understood by those of ordinary skill in the art. The data utilized by computer system 220 to correct image data 210 may be provided by calibration data 150. Dotted arrows 230 between calibration data 150, computer system 220, and display 140, depict that calibration data 150 may be located in an on-board memory (e.g., TCON, extended display identification data (EDID), or DisplayID) of display 140, in a storage device of computer system 220, and/or externally from either computer system 220 or display 140, as may be desired and appropriate for the particular configuration at hand.

Figure 3:
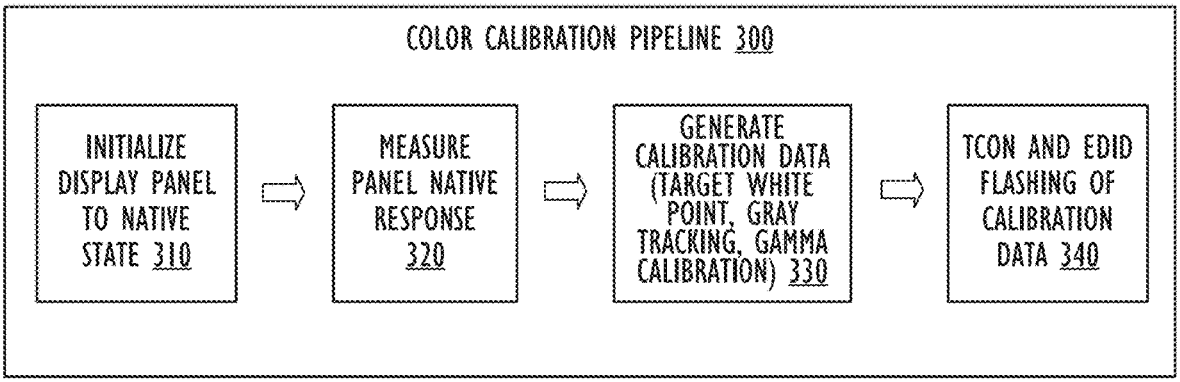
FIG. 3 illustrates a color calibration pipeline for calibration of a display device, in accordance with one or more embodiments.

Referring now to FIG. 3, a typical color calibration pipeline 300 for color calibration of a display panel is illustrated. Color calibration pipeline 300 may be implemented in a factory during manufacture of the display panel for achieving the best color performance of the display device and ensure correctness of a color model (e.g., RGB, CMYK, CIEXYZ, CIELAB, and the like) used in color management by the display device. Color management may refer to controlled conversions between color models or color spaces of various devices so as to obtain a good color match across the color devices. This produces consistent color rendering across all display devices contributing to high color quality and faithful reproduction of colors as per a source content author's rendering intent.

As shown in FIG. 3, color calibration pipeline 300 may include initializing the display panel to a native (uncorrected) state (block 310). That is, the display panel to be calibrated may be set in a native mode where no color corrections are applied to various color channels (e.g., RGB) of the display. Thus, at block 310, all color channels may be driven at full power. At block 320, the calibration system (e.g., calibration system 100 of FIG. 1) implementing color calibration pipeline 300 may measure a native response of the display panel. That is, the calibration system implementing pipeline 300 may measure chromaticity of RGB primaries of the display together with other parameters (e.g., native white point measurement). Based on the native panel response measurement at block 320, the calibration system 100 implementing pipeline 300 may perform various calibrations including white point, gray tracking and gamma calibrations, and generate calibration data (block 330). For example, at block 330, calibration system 100 may generate data (e.g., RGB adjustment values for the target white point in a LUT) that calibrates the display panel to a target white point (e.g., D65) from the native white point response of the display panel. This calibration data may be in a form of tables or numeric values. Calibration data 150 together with the RGB primary measurements may then be flashed into the TCON and EDID or DisplayID of the display panel at block 340. The calibration data flashed into the display panel at block 340 may constitute the calibration information of the display device.

When the display device may then be connected to a computer system (e.g., computer system 220 in FIG. 2), an operating system (OS) may detect the EDID (or DisplayID) of the display and automatically build an International Color Consortium (ICC) profile. The ICC profile may be used by an integrated Color Management System of the OS to accurately transform any RGB system color into an RGB display color within the display color gamut that is displayable on the display device (e.g., display 140).

As described above, the display may be calibrated (and corresponding calibration data for performing color correction generated) to a predetermined target white point. However, during operation, the white point of the display may be shifted constantly from the target white point to white points having different chromaticities, based on a variety of factors including ambient light conditions, user operation, and the like. Such shifting of the white point may result in a chromatically imbalanced white point where, e.g., the driving voltage for one or more of the primary color channels is much higher than the other channels. For example, based on ambient light detected by an ambient light sensor of a portable electronic device incorporating the display device, the white point of the display may be shifted so that the white point takes on a certain hue that is away from the target white.

As another example, a portable electronic device incorporating the display device may include a "night-time" mode that results in a chromatically imbalanced white point in which the colors (and hence the white point) of the display are shifted to the warmer end of the color spectrum, to emit more yellowish-reddish light and less blue light. That is, in the "night-time" mode, since blue light is considered to cause the brain to restrict production of melatonin, the sleep hormone, the display may be programmed to emit a yellowish-reddish white, and move away from blueish white, in order to promote sleep at night-time. Yet another example of a mode that results in a chromatically imbalanced white point may be a "day-time" mode where the colors of the display are shifted to the cooler end of the spectrum, to emit more bluish light and less yellowish-reddish light.

Figure 4:
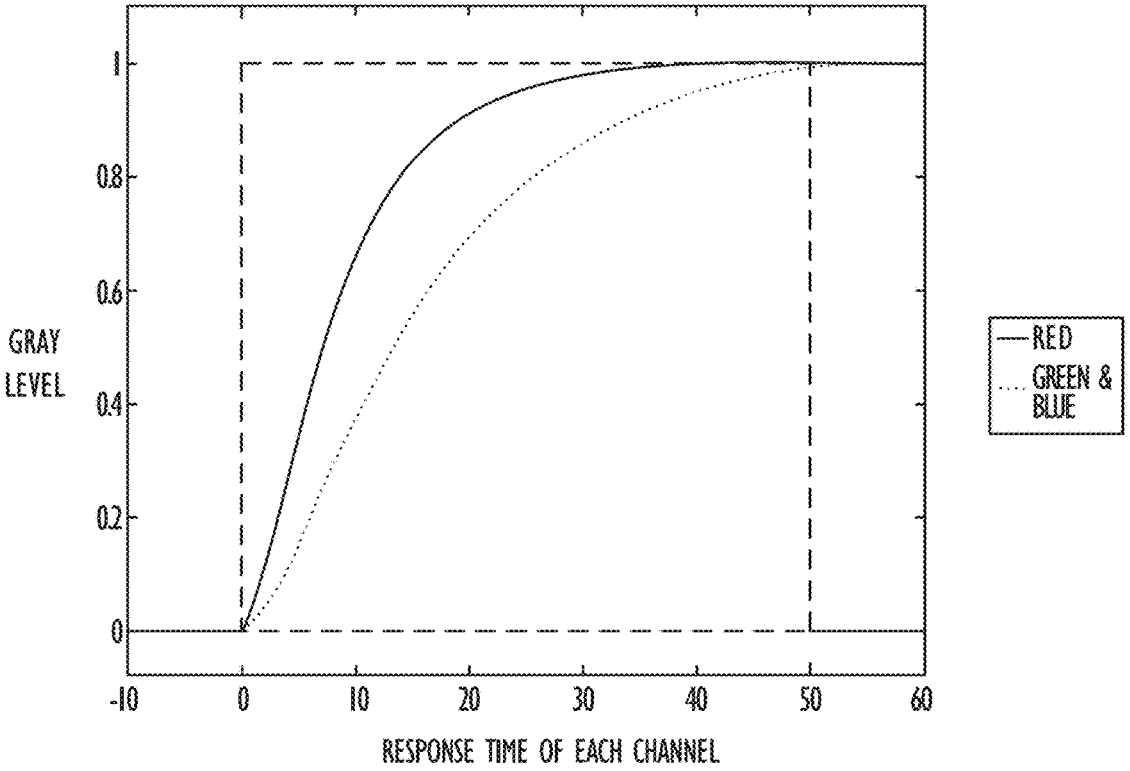
FIG. 4 shows a graph illustrating the relationship between response time and normalized gray level intensity for each of red, green, and blue channels, in accordance with one or more embodiments.

In this case, when the display in the "night-time" mode has a yellow-reddish white point with a low CCT (e.g., around 2700K), display red subpixels are driven at a higher grey level than green and blue subpixels. This also means the red subpixels are driven at higher voltage than green and blue subpixels. As shown in FIG. 4, the different driving voltages between R, G, B causes a pixel turn-on response time difference among the R, G, B subpixels. In this particular case, red subpixels turn on faster than green and blue subpixels.

The driving voltage and response time difference among R, G, B pixels in the illustrative example of the "night-time" mode has the following consequences: (i) when a dark object moves across a yellowish-reddish white background, red subpixels turn on faster than green and blue subpixels, which causes a reddish trail (e.g., motion-induced color breakup or color trail artifact) following the dark object on the display; and (ii) when a yellowish-reddish white object moves across a dark background, red subpixels turn off faster than green and blue subpixels, which causes a cyanish trail (e.g., motion-induced color breakup or color trail artifact) following the white object. This means that moving images in the "night-time" mode may show an undesirable reddish trail during low to high gray level transitions, and an undesirable cyanish trail during the high to low gray level transitions. This motion-induced color breakup or color trail artifact caused by the difference in the sub-pixel response time of the display panel is because the display panel is driven at different voltages in red versus green and blue channels. The effect is illustrated in FIG. 4, which shows the significant differences in the response time of the liquid crystal material due to the unbalanced driving voltage in the "night-time" mode. In FIG. 4, X-axis represents the response time of each color channel in milliseconds, and the Y-axis represents normalized gray level intensity of each color channel. As shown in FIG. 4, the response time of the red channel is faster than the green and blue channels when the panel is operating in the "night-time" mode.

Although FIG. 4 shows the green and blue channels as having the same response time curve, this may not necessarily be the case. Further, although FIG. 4 illustrates the motion-induced color breakup or color trail artifacts caused by the red channel as having a faster response time than the other channels in the "night-time" mode, similar motion-induced color breakup or color trail artifacts may also result in other situations. For example, when the white point is shifted to a blueish-white in response to ambient light conditions (or based on user operation), similar motion-induced color breakup or color trail artifacts may be caused by the blue channel having a faster response time than the red and green channels. In other words, the above described problem of the motion-induced color breakup or color trail artifacts may occur any time when the white point may be shifted away from the target white point curve so that there is an imbalance in the intensity of the constituent red, green, and blue channels. Further, the greater the imbalance of the shifted white point is between intensities of the constituent red, green, and blue channels, the higher the response time imbalance between the channels will be, resulting in more pronounced the motion-induced color breakup or color trail artifacts. Although FIG. 4 describes motion-induced color breakup or color trail artifacts in case of a display having three color channels (e.g., RGB), this may not necessarily be the case. The motion-induced color breakup or color trail artifacts may also manifest in case of a display panel having two color channels, or more than three color channels.

A hardware solution to the motion-induced color breakup problem involves changing the panel design. For example, to correct for the motion-induced color breakup in the "night-time" mode (where the white point is shifted to the yellowish-reddish side), the aperture of the red subpixels could be intentionally increased. This, in turn, could be compensated for by reducing the driving voltage of the red subpixel, which, in turn, could rebalance the driving voltage of the three channels, even in a "night-time" or other chromatically-imbalanced white point mode. The effect of such a hardware solution would be a well-balanced response time in all three channels, and thus a reduction of the undesired color trail artifacts mentioned above.

Figure 5:
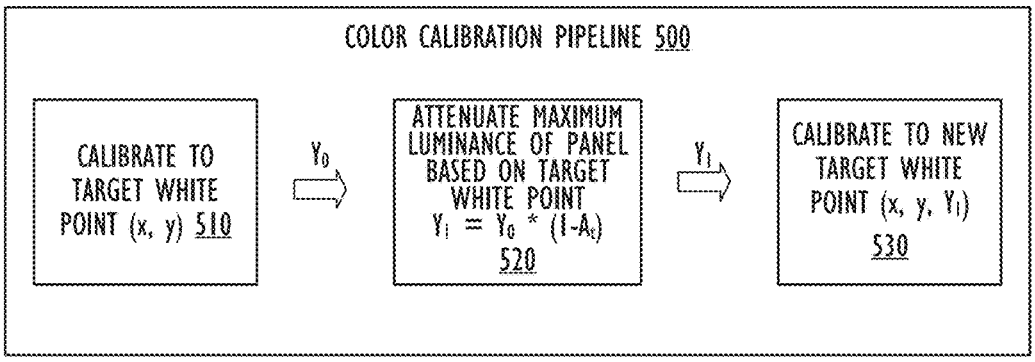
FIG. 5 illustrates another embodiment of a color calibration pipeline for calibration of a display device.
Figure 6:
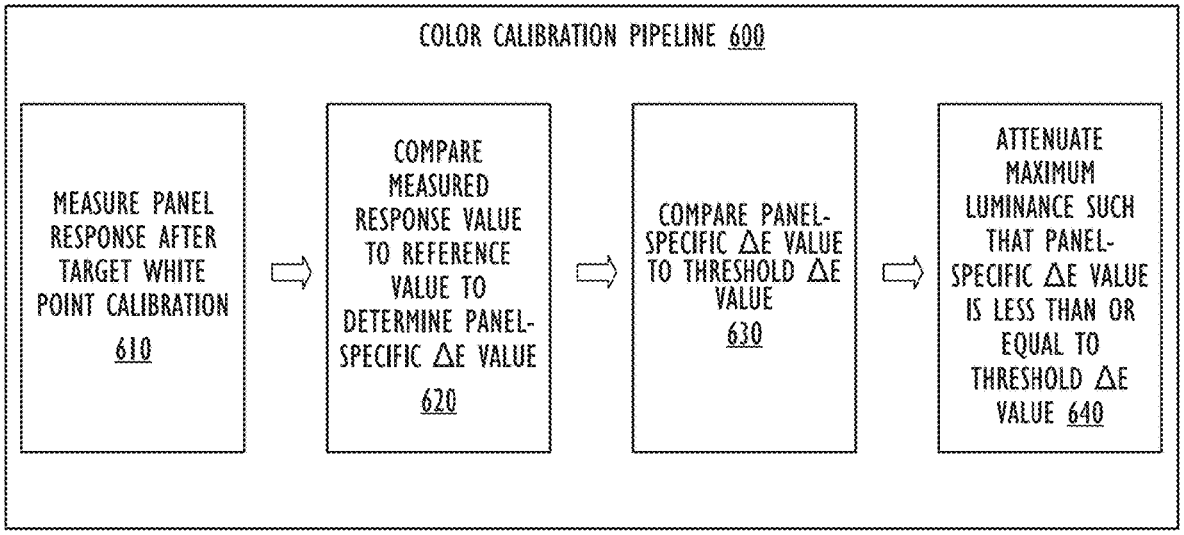
FIG. 6 illustrates yet another embodiment of a color calibration pipeline for calibration of a display device.

Other solutions to address the motion-induced color breakup problem may involve changes to the color calibration pipeline, as illustrated in FIGS. 5 and 6. These solutions can be applied to existing panels to reduce motion-induced color breakup artifacts. As shown in FIGS. 5 and 6, these solutions involve modifying the color calibration pipeline of generating calibration data (e.g., RGB adjustment values corresponding to the target white point) for the display panel.

FIG. 5 illustrates color calibration pipeline 500 for calibration of the display panel, in accordance with one or more embodiments. As shown in FIG. 5, color calibration pipeline 500 may include calibrating the display panel (e.g., display 140) to a target white point (block 510). At block 510, as explained previously in connection with color calibration pipeline 300 in FIG. 3, red, green, and blue channels for the display device may all be driven at full power, and the resulting (x, y) chromaticity value corresponding to the native white point may be measured using a measurement instrument. Further, at block 510, the calibration system implementing color calibration pipeline 500 may calibrate the display panel to the target white point by generating calibration data (e.g., RGB adjustment values in LUT) that produces the target white point represented by target chromaticity coordinates ($x_0$, $y_0$). Still further, at block 510, the calibration system implementing color calibration pipeline 500 may determine the maximum luminance value $Y_0$ corresponding to the target white point for the display panel based on the generated calibration data corresponding to chromaticity coordinates ($x_0$, $y_0$). In one embodiment, the maximum luminance value $Y_0$ may correspond to luminance produced by the display panel when displaying RGB values based on the calibration data for the target white point. That is, the maximum luminance value $Y_0$ may be the maximum possible luminance value the display is capable of producing while achieving the target chromaticity coordinates ($x_0$, $y_0$) of the target white point.

At block 520, the calibration system implementing color calibration pipeline 500 may determine an attenuation factor $A_t$ of the maximum luminance value $Y_0$, and determine an attenuated maximum luminance value $Y_1$ after the attenuation. That is, at block 520, the calibration system implementing color calibration pipeline 500 may attenuate the maximum luminance value $Y_0$ corresponding to the target white point by an attenuation factor $A_t$ that is based on an attenuation function, so as to output an attenuated maximum luminance value $Y_1$. In one embodiment, the attenuation factor $A_t$ may be a predetermined function (selected function) of the maximum luminance value of the calibrated panel $Y_0$. For example, if the $Y_0$ is large, $A_t$ may be 5% so that a larger attenuation is applied to $Y_0$, and as a result, the motion-induced color breakup artifact is strongly masked. If $Y_0$ is small, $A_t$ may be 3% so that a smaller attenuation is applied to $Y_0$, and as a result, excessive reduction in the display brightness is prevented. Thus, the attenuated maximum luminance value is $Y_1=Y_0*(1-A_t)$, where $A_t=f(Y_0)$. The function $f(Y_0)$ may be linear equation. Alternately, the function $f(Y_0)$ could be a curve, a non-linear function, a smoothing function, or the like. In one embodiment, the function $f(Y_0)$ is determined based on empirical data that represents the optimum tradeoff between the amount of the acceptable brightness loss and the visibility of the motion-induced color breakup or color trailing artifacts. For example, the function $f(Y_0)$ may be the result of experiments conducted in a laboratory environment that sets the "ground truth" for reduction of visibility of the motion-induced color breakup or color trailing artifacts to a sufficient level by attenuating the maximum luminance value $Y_0$ of the display. The experiments may further set the ground truth for the optimum tradeoff between loss of brightness of the display panel caused by attenuating the maximum luminance value $Y_0$ on the one hand, and sufficient reduction of visibility of the motion-induced color breakup or color trailing artifacts on the other. In one embodiment, different functions $f(Y_0)$ may be defined for differently shifted white points. For example, the function $f(Y_0)$ used when attenuating for a yellowish-reddish white point of the "night-time" mode may be different from the function $f(Y_0)$ used when attenuating for a bluish white point of the "day-time" mode.

At block 530, the calibration system implementing color calibration pipeline 500 may re-calibrate the display panel for the target white point having chromaticity coordinates ($x_0$, $y_0$) and the attenuated maximum luminance value That is, at block 530, the calibration system implementing color calibration pipeline 500 may generate calibration data (e.g., RGB adjustment values corresponding to the target white point ($x_0$, $y_0$, $Y_1$) in the first row of the LUT) corresponding to the attenuated target white point ($x_0$, $y_0$, $Y_1$) that effectively reduces visibility of the motion-induced color breakup or color trail artifact generated when the white point of the display is shifted to have an imbalance between RGB channels (e.g., during "night-time" mode). At block 530, the generated calibration data corresponding to the attenuated maximum luminance value may further be used to perform additional calibrations including, e.g., gamma calibration, gray tracking calibration, and the like. The display may thereby be calibrated to faithfully reproduce the full range of gray levels from white (e.g., represented by the target white point ($x_0$, $y_0$) with attenuated maximum luminance value $Y_1$) to black on the display device so that the shades of gray (e.g., linear range of R=G=B from 0 to 1) at different luminance levels will all appear to have the same hue as the target white point (e.g., target chromaticity coordinates ($x_0$, $y_0$) for every gray level), and the highest luminance level of gray (e.g., attenuated maximum luminance value $Y_1$) will correspond to the brightness of the target white point. The calibration system implementing color calibration pipeline 500 may then flash the generated calibration data in the TCON of the display panel.

After attenuating the maximum luminance of the target white point (block 520), re-calibrating the panel to the new target white point ($x_0$, $y_0$, $Y_1$), and generating corresponding calibration data (block 530), when the display panel is driven with a "shifted" white point (e.g., in "night-time" mode, based on feedback from ambient light sensor, based on user operation, and the like), imbalance in driving voltages between the RGB channels is reduced, and as a result, imbalance of the response time between RGB channels is also reduced. This in turn rebalances of the response time of the panel, and in effect, reduces significantly the color trailing edge effect in moving images.

In the embodiment shown in FIG. 5, color calibration pipeline 500 is illustrated as having three separate blocks including block 510 where the display panel is calibrated to the target white point having chromaticity ($x_0$, $y_0$), block 520 where the native luminance $Y_0$ of the target white point calibrated display panel is attenuated based on attenuation factor $A_t$ to derive attenuated luminance value and block 530 where the attenuated maximum luminance $Y_1$ is used to re-calibrate the display panel (e.g., generate RGB adjustment values for LUT) to target chromaticity ($x_0$, $y_0$) and target luminance value $Y_1$. In an alternate embodiment, functionality of blocks 510-530 may be combined into a single integrated white point calibration step that calibrates the display panel directly to target chromaticity ($x_0$, $y_0$) and target luminance value $Y_1$ based on function $f(Y_0)$, without any prior knowledge of native luminance $Y_0$ of the panel. For example, a white point calibration algorithm that measures the output when the red, green, and blue channels for the display panel are being driven at full power, may determine RGB adjustment values to adjust the red, green, and blue channels to produce the desired target white point chromaticity ($x_0$, $y_0$). The white point calibration algorithm may further may take as an input, an attenuation factor $A_t$ determined based on the attenuation function $f(Y_0)$, where luminance value $Y_0$ is derived by the algorithm based on the determined RGB adjustment values corresponding to the desired target white point chromaticity ($x_0$, $y_0$). Thus, by including attenuation factor $A_t$ as an input parameter within the white point algorithm, the white point algorithm may directly calibrate the display panel to an attenuated target white point ($x_0$, $y_0$, $Y_1$), without any prior knowledge of the maximum luminance value $Y_0$ of the display panel.

FIG. 6 illustrates yet another embodiment of color calibration pipeline 600 for calibration of a display device. Instead of attenuating a maximum luminance $Y_0$ of the calibrated display panel based on empirical data as illustrated in the embodiment disclosed in FIG. 5, the calibration system implementing color calibration pipeline 600 may programmatically attenuate maximum luminance $Y_0$ of the display panel, so that the amount of attenuation (e.g., attenuation factor $A_t$) to be applied to luminance $Y^0$ is a function of visibility of the trailing edge. In order to programmatically attenuate maximum luminance $Y_0$, the calibration system implementing color calibration pipeline 600 may predetermine based on lab experiments, a threshold delta E (ΔE) value (e.g., 2 ΔE, 3 ΔE, and the like) that defines the threshold amount of perceptual color difference between two colors for the two colors to be considered as different. In other words, the threshold ΔE value may be set experimentally so that when a degree of color shift between the actual color value of a selected test image and a color response value of the test image as actually measured by a measurement instrument while the test image is being displayed on the display panel is determined to be less than the threshold defined by the threshold ΔE value, the difference is considered imperceptible by human eyes (or tolerable), i.e., the two colors are considered to be the same. Once this threshold ΔE value is defined, a measurement instrument can attenuate maximum luminance of multiple calibrated display panels (e.g., attenuate from $Y_0$ to $Y_1$), each having different unique characteristics, without having to re-determine the threshold ΔE value for each panel. In one embodiment, different threshold ΔE values may be defined for differently shifted white points. For example, the threshold ΔE value used when attenuating for a yellowish-reddish white point of the "night-time" mode may be different from the threshold ΔE value used when attenuating for a bluish white point of the "day-time" mode.

As shown in FIG. 6, the calibration system implementing color calibration pipeline 600 may measure panel response after target white point calibration at block 610. That is, similar to color calibration pipeline 500 of FIG. 5, color calibration pipeline 600 at block 610 may also begin with calibrating the display panel to the target white point ($x_0$, $y_0$). After target white point ($x_0$, $y_0$) calibration, and corresponding maximum luminance value $Y_0$ determination, at block 610, the calibration system implementing color calibration pipeline 600 outputs predetermined test and calibration image or video color calibration signals (e.g., selected still and moving color patches or patterns) to the display panel, and queries a measurement instrument (e.g., unit 130 in FIG. 1) to determine what is actually displayed by the display panel in response to the output calibration signals. For example, a moving checkerboard or line pattern may be displayed (e.g., a black pattern on a (white point-shifted) white background or a (white point-shifted) white pattern on a black background) and the measurement instrument may measure color response value of the moving pattern over a predetermined area of the display.

At block 620, the calibration system implementing color calibration pipeline 600 may compare the actually measured color response value output by the measurement instrument with the actual predetermined reference value corresponding to the output calibration signals to determine the degree of color shift (e.g., specific ΔE value) corresponding to the specific display panel. For example, the system may compare the actually measured color response value with the reference value for the checkerboard pattern and determine the difference between the two values as the panel-specific ΔE value. At block 630, the calibration system implementing color calibration pipeline 600 may compare the panel-specific ΔE value obtained at block 620 with the predetermined threshold ΔE value (obtained previously based on, e.g., lab experiments) to determine whether or not the specific ΔE value is less than or equal to the threshold ΔE value.

If the calibration system implementing color calibration pipeline 600 determines that the panel-specific ΔE value is greater than the threshold ΔE value, at block 640, the calibration system may attenuate (e.g., iteratively reduce step-by-step with a predetermined step-size) the maximum luminance value $Y_0$ of the calibrated display panel so that the specific ΔE value becomes equal to or less than the threshold ΔE value. For example, upon determining that the specific ΔE value is greater than the threshold ΔE value, the calibration system may reduce the maximum luminance value $Y_0$ by a predetermined step size 's' to arrive at a luminance value of $Y_{0-s}$. The calibration system may then re-calibrate the display to the target white point defined by ($x_0$, $y_0$) chromaticity, the maximum luminance value of $Y_{0-s}$, generate calibration data for ($x_0$, $y_0$, $Y_{0-s}$), output test image based on generated calibration data for ($x_0$, $y_0$, $Y_{0-s}$), re-measure the panel response to the output test image, re-compare the actually measured color response value with the actual reference value corresponding to the output test image, re-determine the specific ΔE value, and re-compare the panel-specific ΔE value with the predetermined threshold ΔE value. The calibration system may thus iteratively attenuate (e.g., reduce) the maximum luminance value $Y_0$ by the predetermined step size 's' until specific ΔE value becomes less than or equal to the predetermined threshold ΔE value. In one embodiment, the calibration system may prevent lowering the maximum luminance value of the display panel beyond a certain predetermined minimum luminance $Y_{min}$. Thus, if specific ΔE value does not become less than or equal to the predetermined threshold ΔE value even after attenuating the maximum luminance value of $Y_0$ to $Y_{min}$, the calibration system implementing color calibration pipeline 600 may terminate calibration operations, inform a user, or take another predetermined step.

At block 640, the calibration system implementing color calibration pipeline 600 outputs as the attenuated maximum luminance value $Y_1$, the maximum luminance value $Y_{0-sn}$, where n is the number of steps by which the luminance was attenuated to satisfy panel-specific ΔE≤threshold ΔE. The calibration system may then re-calibrate the display panel for the attenuated target white point ($x_0$, $y_0$, $Y_1$) as previously described, and generate corresponding calibration data (e.g., RGB adjustment values).

The calibration system implementing one or more of color calibration pipelines 300, 500, and 600 may be implemented as part of an assembly line in a factory during manufacture of the display for performing color calibration of the display before shipping to a customer. In this case, the calibration data (e.g., RGB adjustment values corresponding to re-calibrated and attenuated target white point ($x_0$, $y_0$, $Y_1$)) may be flashed into the TCON, EDID or DisplayID of the display for subsequent use by the display when displaying image data. Alternately, the calibration system implementing one or more of color calibration pipelines 300, 500, and 600 may be implemented as an external calibration system that can be utilized on-demand by customers to self-calibrate the display by connecting the calibration system to a system of the display. In this case, the calibration data may be stored in memory external to the display panel, or may be stored in parts of the TCON that are accepting dynamic control (e.g., a 3×3 matrix) for controlling color, color shift, and white point shift. For example, instead of having a normalized matrix in the dynamic part of the TCON, the matrix may be attenuated based on the calibration data generated after re-calibration so as to adjust the maximum luminance of the display panel, and to thereby reduce visibility of the motion-induced color breakup or color trail artifacts when driving the display with a shifted white point.

Figure 7:
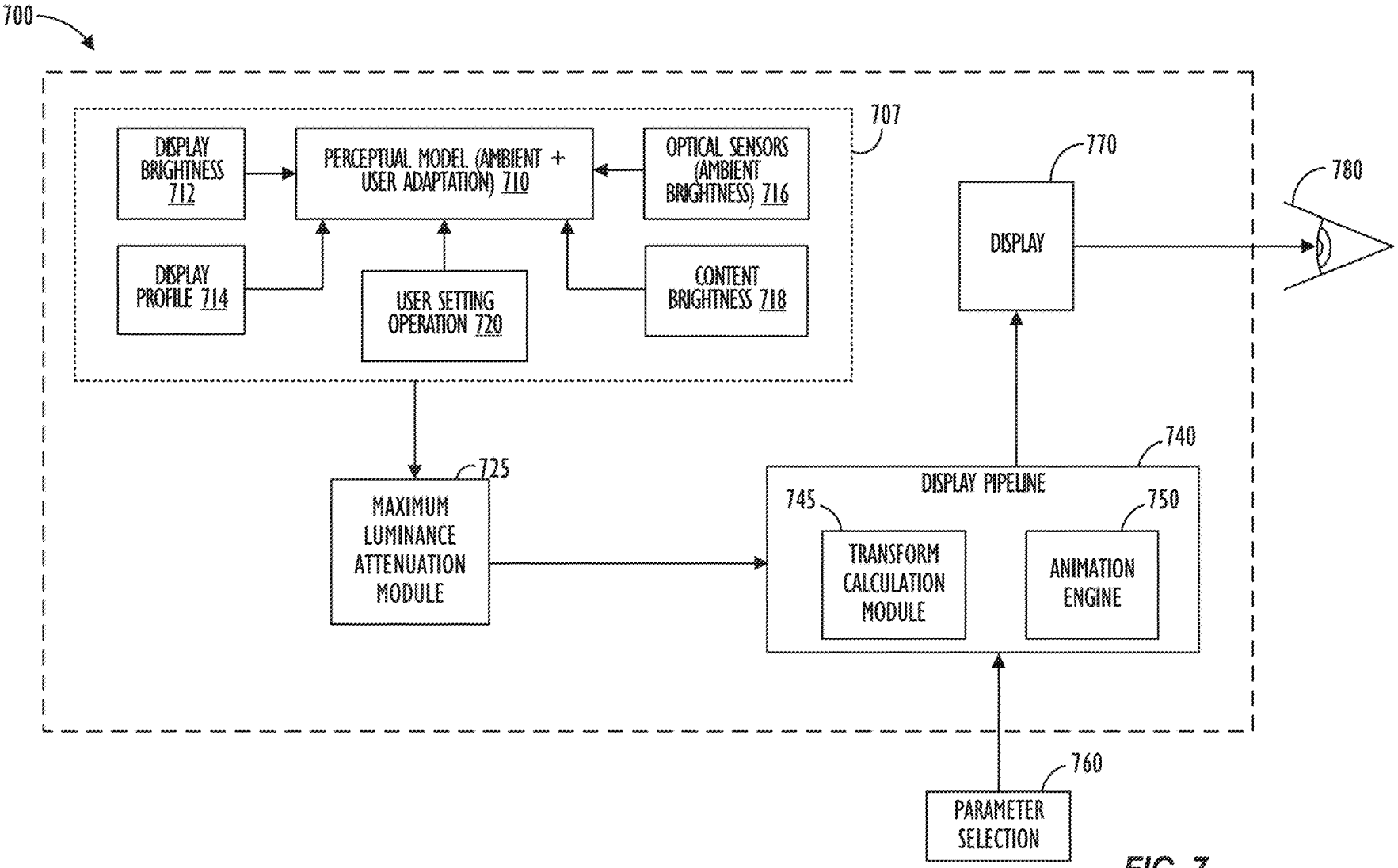
FIG. 7 shows a system for attenuating a maximum luminance of a display panel, in accordance with one or more embodiments.

Referring now to FIG. 7, system 700 for attenuating a maximum luminance of a display panel is illustrated, in accordance with one or more embodiments. As shown in FIG. 7, the attenuated maximum luminance $Y_1$ based on which the calibration data is generated in the calibration pipeline may be further attenuated dynamically, based on perceptual data, user operation, and the like, to further reduce visibility of motion-induced color breakup or color trail artifacts.

In one embodiment, system 700 for attenuating a maximum luminance of display 770 may be comprised in a device of viewer 780. Viewer 780's device (e.g., device 140 of FIG. 1) may comprise, for example, a mobile phone, PDA, HMD, monitor, television, or a laptop, desktop, or tablet computer. Perceptual model 710 may be used to implement a perceptually-aware and/or content-aware system to dynamically adjust display 770 by modeling the user's perception of the displayed image data to keep the user's experience of the displayed content relatively independent of the ambient conditions in which display 770 is being viewed and/or the content that is being displayed. Perceptual model 710 may collect information about the ambient lighting conditions in the environment of viewer 780 of display 770. Perceptual model 710 may evaluate at least received environmental information, the viewer 780's predicted adaptation levels, and information about display 770, as well as the image data itself that is being, has been, or will be displayed to viewer 780. Based on the evaluation, perceptual model 710 may output adjustments to the calibration data such that the viewer 780's perception of the content displayed on display 770 is relatively independent of the ambient conditions in which the display 770 is being viewed. In particular, perceptual model 710 may output data to further adjust (e.g., increase or decrease) the attenuated maximum luminance $Y_1$ of display 770, so that visibility of motion-induced color breakup or color trail artifacts is reduced when the white point is shifted from the target white point to chromaticities that cause an imbalance between RGB channels. Such dynamic adjustment (attenuation) of the display maximum luminance may allow system 700 to avoid unnecessarily reducing the maximum luminance of the display 770 (e.g., in environments or at times when the viewer's adaptation is such that he or she would not be able to perceive any added benefit provided by the reduced luminance of the display), while at the same time ensuring that motion-induced color breakup or color trail artifacts remain imperceptible to the viewer 780.

As illustrated within dashed line box 707, perceptual model 710 may take various factors and sources of information into consideration. For example, perceptual model 710 may take into consideration information indicative of ambient light conditions obtained from one more optical sensors 716 (e.g., ambient light sensors, image sensors, and the like). Perceptual model 710 may also take into consideration information indicative of display profile 714's characteristics (e.g., an ICC profile, an amount of static light leakage for the display, an amount of screen reflectiveness, a recording of the display's 'first code different than black,' a characterization of the amount of pixel crosstalk across the various color channels of the display, display 770's color space, native display response characteristics or abnormalities, the type of screen surface used by the display, etc.). Further, perceptual model 710 may take into consideration the display's brightness 712 (e.g., native device gamut of display 770); the displayed content's brightness 718; and/or a user's setting operation 720 (e.g., user input) regarding desired display brightness levels, user's adaptation levels, and the like. In some embodiments, perceptual model 710 may also take into consideration predictions from a color appearance model, e.g., the CIECAM02 color appearance model or the CIECAM97s model. Color appearance models may be used to perform chromatic adaptation transforms and/or for calculating mathematical correlates for the six technically defined dimensions of color appearance: brightness (luminance), lightness, colorfulness, chroma, saturation, and hue. In other embodiments, perceptual model 710 may also take into consideration information based on historically displayed content/predictions based on upcoming content. For example, the model may consider both the instantaneous brightness levels of content and the cumulative brightness of content a viewer has viewed over a period of time.

Perceptual model 710 may then evaluate such information to predict the effect on the viewer's perception due to ambient conditions and adaptation and/or suggest modifications to calibration data (e.g., white point, gamma, and the like) for the viewer's current adaptation level. For example, when perceptual model 710 determines based on ambient light levels and viewing conditions that viewer 780 is adapted to a low light (e.g., dim or night-time conditions, theater conditions, or when wearing head mounted device (HMD)) viewing environment, perceptual model 710 may suggest modification to calibration data to further adjust (attenuate) the maximum luminance $Y_1$ of display 770. That is, when viewer 780 is adapted to a dark environment, appearance of even the slightest motion-induced color breakup or color trail artifacts may be perceptible to the viewer 780 when the white point is shifted during operation. In this case, perceptual model 710 may detect that the maximum luminance $Y_1$ of display 770 should be attenuated further to adequately mask the color trail artifacts, based on current ambient light conditions, and the current shifted white point with imbalance between RGB channels. Conversely, if the user is adapted to bright/outdoor conditions, the color trail artifact may be less visible to the user, and in this case, perceptual model 710 may detect that the maximum luminance $Y_1$ of display 770 may be attenuated less, thereby preventing brightness loss, while at the same time ensuring that the color trail artifact remains sufficiently imperceptible to the user. In one embodiment, the empirical data of color calibration pipeline 500 may include additional attenuation function data where the attenuated maximum luminance value is a function of both the current maximum luminance value and the current viewer adaptation levels. Using this additional attenuation function data, perceptual model 710 may determine the attenuation factor $A_t$ (e.g., adjusted attenuation factor) by which the current maximum luminance value $Y_1$ is to be attenuated to adequately mask the color trail artifact at current ambient light conditions and current user adaptation levels. In another embodiment, the lab experiment data of color calibration pipeline 600 may include data regarding ambient-light-level-specific threshold ΔE values (e.g., threshold ΔE getting smaller as ambient environment gets darker). For example, in a dark environment the Just Noticeable Difference between two colors for a user may be different (lower) than in an outdoor (bright) environment where the user has been for a long time. Based on current ambient light conditions and current user adaptation levels, perceptual model 710 may dynamically determine what the current threshold ΔE value is and attenuate the maximum luminance $Y_1$ of the panel 770 based on the relation between the attenuation at a previous threshold ΔE value, and the current obtained threshold ΔE value (e.g., adjusted attenuation factor).

Perceptual model's 710 suggested modifications to calibration data may be applied by maximum luminance attenuation module 730 dynamically to transform display characteristics of display 770. To implement the above described dynamic transformation of display's 770 characteristics, system 700 may include display pipeline 740. Display pipeline 740 may include transformation calculation module 745 and animation engine 750 (described in further detail below). In one embodiment, transformation calculation module 745 may modify parts of the display's 770 TCON that are accepting dynamic control (e.g., a 3×3 matrix) for controlling color, color shift, and white point shift. For example, instead of having a normalized matrix in the dynamic part of the TCON, the matrix may be attenuated based on the modifications to the calibration data so as to adjust the maximum luminance of the display panel by the adjusted attenuation factor, and to thereby reduce visibility of the motion-induced color breakup or color trail artifacts.

Display pipeline 740 may further dynamically transform display characteristics of display 770 (e.g., attenuate maximum luminance of display 770) based on one or more input parameters (e.g., parameter selection 760, and the like). Parameter selection 760 may be implemented as a slider for allowing the user to fine tune to a desired level or degree of shift of the white point in a particular mode. Parameter selection 760 may thus allow the user to select the amplitude of the shifting of the white point to be applied to display image data. In one embodiment, parameter selection 760 may be manually input by the user. Alternately, the intensity of the effect may be automatically selected by system 700 based on data from perceptual model 710. For example, viewer 780 may selectively input 760 a level (e.g., intensity between 0 and 1) of the shifted white point in "night-time" mode. In this case, display pipeline 740 may dynamically suggest modification to the calibration data as a function of the selected parameter 760 so that the higher the level of shift of the white point is (e.g., the more chromatically-imbalanced the white point is), the more the attenuation applied to the maximum luminance $Y_1$ of the display 770 is. The amount of attenuation to be applied as a function of selected parameter 760 may be selected based on empirical data so that the color trail effect is adequately masked for each increasing level or intensity of "shifted" white point, without unnecessarily lowering the maximum luminance of the display.

Based on the input parameter 760, and based on output of the perceptual model 710 regarding ambient light and user adaptation, transformation calculation module 745 of display pipeline 740 may apply a transformation to adjust or modify calibration data (e.g., RGB adjustment values corresponding to the calibrated target white point and attenuated luminance value) in order to account for the intensity of the shifting of the white point. The transformation may be applied as an analytical function defining vector equations (e.g., matrix equations). The analytical function may be implemented as a simple linear equation. Alternately, the analytical function could be a curve, a non-linear function, a smoothing function, and the like. In another embodiment, the transformation may be applied via one or more LUTs (e.g., 3D LUTS). Display pipeline 740 may further include animation engine 750 to animate application of the transformation to be applied to the calibration data by transform calculation module 745, based on the rate at which it is predicted the viewer's vision will adapt to the changes. For example, when it is determined that changes to the calibration data should be made based on transformation applied by transform calculation module 745, animation engine 750 may determine the duration (predetermined period of time) over which such changes should be made and/or the 'step size' for the various changes. Thus, animation engine 750 may gradually "fade in" the new attenuated maximum luminance value of the display 770, based on output of perceptual model 710 and/or parameter selection 760. Modified calibration data may be applied to image data by display pipeline 740 to generate display content formatted for display on display 770.

The features of system 700 may be implemented using hardware resources including one or more processors and one or more graphics processing units (GPUs) to render and display image data. The processors may be implemented using one or more central processing units (CPUs), where each CPU may contain one or more processing cores and/or memory components that function as buffers and/or data storage (e.g., cache memory). The processors may also be part of or are coupled to one or more other processing components, such as application specific integrated circuits (ASICs), field-programmable gate arrays (FPGAs), and/or digital signal processors (DSPs). The hardware resources may be able to utilize the processors, the GPUs, or simultaneously use both the GPUs and the processors to render and display source content. Hardware resources may also include other types of hardware resources (e.g., memory) known by persons of ordinary skill in the art for rendering and displaying image data.

The color calibration method described herein produces several advantages. First, the method does not require redesign of the panels, resulting in a great saving cost and time. Second, the method can be applied at factory calibration time without changing the calibration process and pipeline, and without requiring extra time. The method does not slow down the calibration process time in the factory, thereby maintaining the yield of the factory line. Third, the method applies the attenuation factor adaptively, so that relatively higher luminance panels are more protected from the motion-induced color breakup artifact, and, at the same time, lower luminance panels are protected from having too large luminance attenuation. Fourth, since the method does not change the target chrominance of the white point, the quality of the calibration is preserved, while reducing visibility of the motion-induced color breakup artifact while driving the panel with a shifted white point and the resulting imbalance between RGB channels that would be caused by such a shifted white point. Finally, the method can be applied at the post-factory calibration stage as well.

Figure 8:
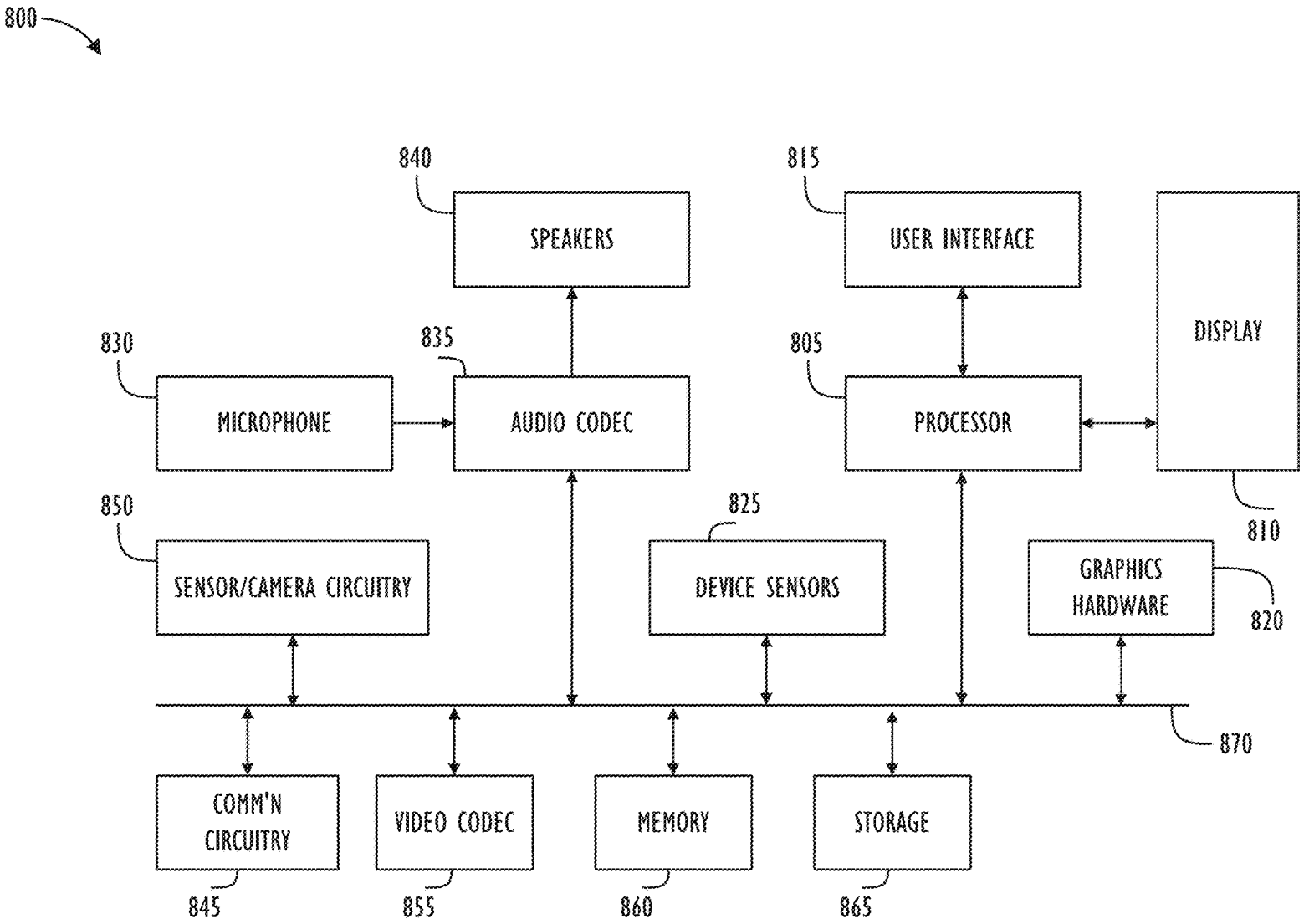
FIG. 8 is a simplified functional block diagram of an illustrative multi-functional electronic device, in accordance with one or more embodiments.

Referring to FIG. 8, a simplified functional block diagram of illustrative device 800 (e.g., computer system 110 of FIG. 1, computer system 220 of FIG. 2, system 700 of FIG. 7, and the like) that performs color calibration and luminance attenuation as described in FIGS. 1-7 is shown. Device 800 may include processor 805, display 810 (e.g., display 140 of FIG. 1, display 770 of FIG. 7, and the like), user interface 815, graphics hardware 820, device sensors 825 (e.g., proximity sensor/ambient light sensor, accelerometer, depth sensor, lidar, laser, IR, and/or gyroscope), microphone 830, audio codec(s) 835, speaker(s) 840, communications circuitry 845, sensor and camera circuitry 850, video codec(s) 855, memory 860, storage 865, and communications bus 870. Electronic device 800 may be, for example, a digital camera, a personal digital assistant (PDA), personal music player, mobile telephone, server, notebook, laptop, desktop, or tablet computer. More particularly, the disclosed techniques may be executed on a device that includes some or all of the components of device 800.

Processor 805 may execute instructions necessary to carry out or control the operation of many functions performed by a multi-functional electronic device 800 (e.g., such as display color calibration, luminance attenuation, and the like). Processor 805 may, for instance, drive display 810 and receive user input from user interface 815. User interface 815 can take a variety of forms, such as a button, keypad, dial, a click wheel, keyboard, display screen and/or a touch screen. Processor 805 may be a system-on-chip such as those found in mobile devices and include a dedicated graphics-processing unit (GPU). Processor 805 may represent multiple central processing units (CPUs) and may be based on reduced instruction-set computer (RISC) or complex instruction-set computer (CISC) architectures or any other suitable architecture and each may include one or more processing cores. Graphics hardware 820 may be special purpose computational hardware for processing graphics and/or assisting processor 805 process graphics information. In one embodiment, graphics hardware 820 may include one or more programmable graphics-processing unit (GPU), where each such unit has multiple cores.

Sensor and camera circuitry 850 may capture still and video images that may be processed to generate images in accordance with this disclosure. Sensor in sensor and camera circuitry 850 may capture raw image data as red, green, and blue (RGB) data that is processed to generate an image. Output from camera circuitry 850 may be processed, at least in part, by video codec(s) 855 and/or processor 805 and/or graphics hardware 820, and/or a dedicated image-processing unit incorporated within camera circuitry 850. Images so captured may be stored in memory 860 and/or storage 865. Memory 860 may include one or more different types of media used by processor 805, graphics hardware 820, and camera circuitry 850 to perform device functions. For example, memory 860 may include memory cache, read-only memory (ROM), and/or random access memory (RAM). Storage 865 may store media (e.g., audio, image and video files), computer program instructions or software, preference information, device profile information, and any other suitable data. Storage 865 may include one more non-transitory storage mediums including, for example, magnetic disks (fixed, floppy, and removable) and tape, optical media such as compact disc-ROMs (CD-ROMs) and digital video disks (DVDs), and semiconductor memory devices such as Electrically Programmable Read-Only Memory (EPROM), and Electrically Erasable Programmable Read-Only Memory (EEPROM). Memory 860 and storage 865 may be used to retain computer program instructions or code organized into one or more modules and written in any desired computer programming language. When executed by, for example, processor 805 such computer program code may implement one or more of the methods described herein.

Figure 9:
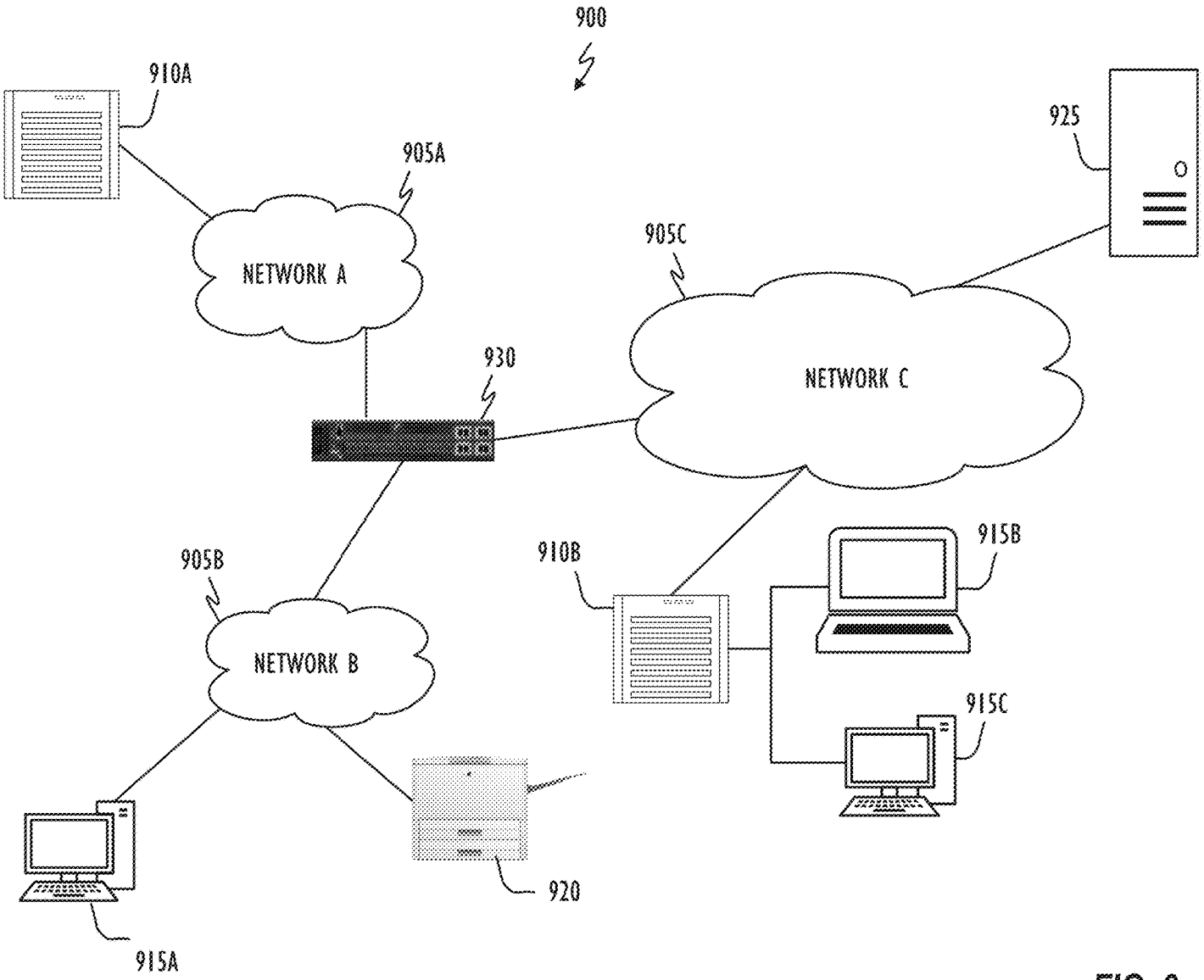
FIG. 9 shows, in block diagram form, a computer network, in accordance with one or more embodiments.

Referring to FIG. 9, illustrative network architecture 900 within which a system for performing display color calibration in accordance with the disclosed techniques may be implemented includes a plurality of networks 905, (e.g., 905A, 905B and 905C), each of which may take any form including, but not limited to, a local area network (LAN) or a wide area network (WAN) such as the Internet. Further, networks 905 may use any desired technology (wired, wireless or a combination thereof) and communication protocol (e.g., TCP, or transmission control protocol and PPP, or point to point). Coupled to networks 905 are data server computer systems 910 (e.g., 910A and 910B) that are capable of communicating over networks 905. Also coupled to networks 905, and/or data server computer systems 910, are client or end-user computer systems 915 (e.g., 915A, 915B and 915C). Each of these elements or components may be a computer system or electronic device as described above with respect to FIGS. 1-8. In some embodiments, network architecture 900 may also include network printers such as printer 920 and network storage systems such as 925. To facilitate communication between different network devices (e.g., server computer systems 910, client computer systems 915, network printer 920 and storage system 925), at least one gateway or router 930 may be optionally coupled there between.

As used herein, the term "computer system" or "computing system" refers to a single electronic computing device or to two or more electronic devices working together to perform the function described as being performed on or by the computing system. This includes, by way of example, a single laptop, host computer system, wearable electronic device, and/or mobile device (e.g., smartphone, tablet, and/or other smart device).

It is to be understood that the above description is intended to be illustrative, and not restrictive. The material has been presented to enable any person skilled in the art to make and use the claimed subject matter as described herein, and is provided in the context of particular embodiments, variations of which will be readily apparent to those skilled in the art (e.g., some of the disclosed embodiments may be used in combination with each other). In addition, some of the described operations may have their individual steps performed in an order different from, or in conjunction with other steps, than presented herein. More generally, if there is hardware support some operations described in conjunction with FIGS. 2-7 may be performed in parallel.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations may be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). The use of the term "about" means ±10% of the subsequent number, unless otherwise stated.

Many other embodiments will be apparent to those of skill in the art upon reviewing the above description. The scope of the invention therefore should be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. A display color calibration method, comprising:

calibrating a display panel to a target white point;

attenuating a maximum luminance value of the display panel from a first luminance value associated with the target white point to a second luminance value based on an attenuation factor, wherein the attenuation factor is determined based on an amount of acceptable brightness loss of the display panel and an amount of reduction in visibility of motion-induced color breakup artifacts, wherein the motion-induced color breakup artifacts are caused, at least in part, by imbalanced response times between the display panel's subpixel color channels, wherein the attenuation factor causes at least a partial rebalancing of the response times between the display panel's subpixel color channels, and wherein the second luminance value is equal to or lower than the first luminance value;

re-calibrating the display panel based on a chromaticity of the target white point and the second luminance value to generate calibration data; and flashing the calibration data into memory associated with the display panel.

2. The display color calibration method according to claim 1, wherein the attenuation factor is further determined as an optimum tradeoff between the amount of acceptable brightness loss of the display panel and the amount of reduction in visibility of motion-induced color breakup artifacts.

3. The display color calibration method according to claim 1, wherein the attenuation factor is a function of the first luminance value, and wherein the attenuation factor is higher when the first luminance value is larger.

4. The display color calibration method according to claim 3, wherein the function is selected based on empirical data.

5. The display color calibration method according to claim 1, further comprising measuring a color shift of a selected pattern displayed on the display panel;

wherein the attenuation factor is further determined based on a degree of the color shift of the selected pattern.

6. The display color calibration method according to claim 5, wherein measuring the color shift of the selected pattern comprises:

displaying the selected pattern on the display panel;

measuring an actual color response value of the selected pattern displayed on the display panel using a measurement instrument; and determining a panel-specific ΔE value based on a comparison of the measured actual color response of the selected pattern with a predetermined reference value associated with the selected pattern;

wherein the attenuation factor is further determined based on a comparison of the panel-specific ΔE value and a threshold ΔE value.

7. The display color calibration method according to claim 6, wherein the threshold ΔE value is predetermined based on a tolerable amount of perceptual color difference between two colors.

8. The display color calibration method according to claim 1, further comprising:

adjusting the attenuation factor based on at least one of an ambient light level a user is perceptually adapted to, and a parameter input by a user; and re-attenuating the maximum luminance value of the display panel from the second luminance value to a third luminance value based on the adjusted attenuation factor.

9. The display color calibration method according to claim 8, wherein the attenuation factor is a function of the ambient light level the user is perceptually adapted to so that the attenuation factor is lower when the ambient light level is higher.

10. A display color calibration system, comprising:

a display panel;

a measurement unit;

memory; and one or more processors operatively coupled to the display panel, the measurement unit, and the memory, wherein the memory comprises instructions that, when executed by the one or more processors, cause the one or more processors to:

calibrate a display panel to a target white point;

attenuate a maximum luminance value of the display panel from a first luminance value associated with the target white point to a second luminance value based on an attenuation factor, wherein the attenuation factor is determined based on an amount of acceptable brightness loss of the display panel and an amount of reduction in visibility of motion-induced color breakup artifacts, wherein the motion-induced color breakup artifacts are caused, at least in part, by imbalanced response times between the display panel's subpixel color channels, wherein the attenuation factor causes at least a partial rebalancing of the response times between the display panel's subpixel color channels, and wherein the second luminance value is equal to or lower than the first luminance value;

re-calibrate the display panel based on a chromaticity of the target white point and the second luminance value to generate calibration data; and flash the calibration data into memory associated with the display panel.

11. The display color calibration system according to claim 10, wherein the attenuation factor is further determined as an optimum tradeoff between the amount of acceptable brightness loss of the display panel and the amount of reduction in visibility of motion-induced color breakup artifacts.

12. The display color calibration system according to claim 10, wherein the attenuation factor is a function of the first luminance value, wherein the attenuation factor is higher when the first luminance value is larger, and wherein the function is selected based on empirical data.

13. The display color calibration system according to claim 10, wherein the memory further comprises instructions that, when executed by the one or more processors, cause the one or more processors to measure a color shift of a selected pattern displayed on the display panel;

wherein the attenuation factor is further determined based on a degree of the color shift of the selected pattern.

14. The display color calibration system according to claim 13, wherein the instructions that, when executed by the one or more processors, cause the one or more processors to measure the color shift of the selected pattern comprise instructions that, when executed by the one or more processors, cause the one or more processors to:

display the selected pattern on the display panel;

measure an actual color response value of the selected pattern displayed on the display panel using a measurement instrument; and determine a panel-specific ΔE value based on a comparison of the measured actual color response of the selected pattern with a predetermined reference value associated with the selected pattern;

wherein the attenuation factor is further determined based on a comparison of the panel-specific ΔE value and a threshold ΔE value.

15. The display color calibration system according to claim 14, wherein the threshold ΔE value is predetermined based on a tolerable amount of perceptual color difference between two colors.

16. The display color calibration system according to claim 10, wherein the memory further comprises instructions that, when executed by the one or more processors, cause the one or more processors to:

adjusting the attenuation factor based on at least one of an ambient light level a user is perceptually adapted to, and a parameter input by a user; and re-attenuating the maximum luminance value of the display panel from the second luminance value to a third luminance value based on the adjusted attenuation factor;

wherein the maximum luminance value is re-attenuated dynamically, in real-time.

17. A non-transitory program storage device, readable by one or more programmable control devices and comprising instructions stored thereon to cause the one or more programmable control devices to:

calibrate a display panel to a target white point;

attenuate a maximum luminance value of the display panel from a first luminance value associated with the target white point to a second luminance value based on an attenuation factor, wherein the attenuation factor is determined based on an amount of acceptable brightness loss of the display panel and an amount of reduction in visibility of motion-induced color breakup artifacts, wherein the motion-induced color breakup artifacts are caused, at least in part, by imbalanced response times between the display panel's subpixel color channels, wherein the attenuation factor causes at least a partial rebalancing of the response times between the display panel's subpixel color channels, and wherein the second luminance value is equal to or lower than the first luminance value;

re-calibrate the display panel based on a chromaticity of the target white point and the second luminance value to generate calibration data; and flash the calibration data into memory associated with the display panel.

18. The non-transitory program storage device of claim 17, wherein the attenuation factor is further determined as an optimum tradeoff between the amount of acceptable brightness loss of the display panel and the amount of reduction in visibility of motion-induced color breakup artifacts.

19. The non-transitory program storage device of claim 17, wherein the attenuation factor is a function of the first luminance value, wherein the attenuation factor is higher when the first luminance value is larger, and wherein the function is selected based on empirical data.

20. The non-transitory program storage device of claim 17, wherein the instructions further cause the one or more programmable control devices to measure a color shift of a selected pattern displayed on the display panel;

wherein the attenuation factor is further determined based on a degree of the color shift of the selected pattern.

* * * * *